US005445690A

United States Patent [19]

Wulfman

[11] Patent Number: 5,445,690

[45] Date of Patent: Aug. 29, 1995

[54] ENVIRONMENTALLY NEUTRAL REFORMULATION OF MILITARY EXPLOSIVES AND PROPELLANTS

[75] Inventor: David S. Wulfman, Mill Village, Canada

[73] Assignee: D. S. Wulfman & Associates, Inc., Rolla, Mo.

[21] Appl. No.: 38,850

[22] Filed: Mar. 29, 1993

[51] Int. Cl.[6] ..... C06B 21/00

[52] U.S. Cl. ..... 149/109.6; 588/202; 264/3.1

[58] Field of Search ..... 149/46, 109.6, 124; 588/202; 264/3.1

[56] References Cited

U.S. PATENT DOCUMENTS

| | | | |
|---|---|---|---|
| 2,991,167 | 7/1961 | Burton | 52/5 |
| 3,046,888 | 7/1962 | Gordon | 102/22 |
| 3,061,488 | 10/1962 | Scott, Jr. | 149/5 |
| 3,090,713 | 5/1963 | Fenix | 149/39 |
| 3,090,714 | 5/1963 | Fenix | 149/43 |
| 3,116,187 | 12/1963 | Scanlon | 149/74 |
| 3,304,211 | 2/1967 | Anderson et al. | 149/11 |
| 3,658,607 | 4/1972 | Cook et al. | 149/2 |
| 3,924,405 | 12/1975 | Cohen et al. | 60/219 |
| 4,061,511 | 12/1977 | Baczuk | 149/19.9 |
| 4,100,000 | 7/1978 | Sterling et al. | 149/4 |
| 4,111,728 | 9/1978 | Ramnarace | 149/19.5 |
| 4,428,786 | 1/1984 | Arni | 149/21 |
| 4,456,492 | 6/1984 | Alexander et al. | 148/8 |
| 4,642,983 | 2/1987 | Melvin et al. | 60/219 |
| 4,889,571 | 12/1989 | Willer et al. | 149/19.9 |

*Primary Examiner*—Donald P. Walsh
*Assistant Examiner*—Anthony R. Chi
*Attorney, Agent, or Firm*—Grace J. Fishel

[57] ABSTRACT

Polymer and wax bound military explosives and propellants are removed from a rocket casing, warhead or the like. Included with the explosive or propellant are materials added to improve brisance, resiliency, etc. of the explosive material and adventitious materials such as glue. The polymer and wax bound military explosive is oxygen balanced with an oxidizing agent in the form that it is removed from the casing, etc. and provided as an explosive, for example, for use as a powerful blasting agent.

11 Claims, No Drawings

ENVIRONMENTALLY NEUTRAL REFORMULATION OF MILITARY EXPLOSIVES AND PROPELLANTS

BACKGROUND OF THE INVENTION

1. Field of the Invention

The present invention relates to reformulating polymer or wax bound military explosives and propellants into a useful form.

2. Brief Description of the Prior Art

A number of explosive compounds used in military explosives and propellants possess properties that are not desired in military warheads and in other military applications. To improve their properties, highly brisant explosives are often embedded in or coated with a curable plastic material or with a wax. When the explosive or propellant is coated with a wax the process is called phlegmatization. Other materials such as rubber can be added to impart specified mechanical properties like elasticity. The term plastic includes gelatinized liquid nitrocompounds of plasticine-like consistency.

Waste military explosives and propellants are a growing disposal problem as a result of world demilitarization. In the past, they have been disposed of by deep sea burial, open burning, open detonation or incineration.

For example, rocket motors have been dumped into the ocean off the continental shelf where the high specific gravity of the solid propellant causes the motors to sink rapidly. The rate at which the propellant leaches out under oceanic conditions is unknown, as are the likely products of hydrolysis. The environmental impact of deep sea burial and the cumulative effect of dumping large tonnages of explosives and propellants is therefore unknown.

In open burning, loose explosive or propellant materials or a complete rocket motor, for example, is placed on the ground or in a tray or pit which may be lined with a concrete pad. An explosive train leading to the material is used to initiate burning. The burning explosive or propellant creates a large updraft dispersing a plume of combustion products into the atmosphere.

The combustion products of open detonation are similar to those produced during open burning. Incineration is cleaner but requires special incinerators and safety considerations since explosives and propellants can burn with intense heat and some can explode. Emissions of HCl, $NO_x$ and HCN and particulates such as aluminum oxides, requires expensive air pollution control devices. The combustion products may be highly corrosive, thus affecting capital and maintenance costs.

Other disposal methods for destroying explosives or propellants include converting them into a less noxious form through chemical conversion, biodegradation, electrochemical oxidation, supercritical oxidation and so forth. All of these disposal methods involve high investment costs and/or may result in the same or different regulatory or environmental problems as deep sea burial, open burning, etc. In addition, destruction of the explosive or propellant (including conversion into a less noxious form for disposal) is contrary to the Resource Conservation and Recovery Act (RCRA).

Reclamation of the explosives or propellants as opposed to destroying them is in compliance with RCRA but reclamation requires the identification of a solvent which will dissolve the explosive or propellant out of the materials that are added to improve its properties. When the explosive or propellant is polymer bound, reclamation may not be possible when the polymer is too highly cross-linked.

One such reclamation method uses waterjets to wash out the explosive or propellant from the warhead or the like. The washed out material is passed over a vibrating screen which separates solids and liquids. Solid materials are placed in containers such as fiber drums and disposed of by open burning. The solvent is recirculated until the reclaimed explosive or propellant reaches a level at which the solvent is discharged into an open evaporation basin or treated in some other way (i.e., crystallization, etc.). In addition to the reclaimed material, the above reclamation process results an explosive-contaminated binder and an explosive-contaminated solvent, giving rise to a host of other disposal problems. Moreover, there is no guarantee that the reclaimed material will requalify to meet military specifications and in some cases it has no other legitimate customer.

There is a need for a process where the military explosive or propellant could be used without reclaiming it from the materials added to improve its properties. One proposed process uses military explosives or propellants as an extender in commercial explosives. In an oxygen-balanced explosive, the amount of oxygen present is just sufficient to oxidize all carbon to $CO_2$ and all hydrogen to $H_2O$ and any metals to their oxides with a minimum production of toxic $NO_x$, CO and HCN. If there is insufficient oxygen to do this, the oxygen balance is negative. Excessive amounts of oxygen should be avoided because the amount of energy liberated is greatest at a slightly negative oxygen balance with explosives, for example, containing only C, H, N and O. Most military explosives and propellants, however, are oxygen deficient so that the full energetic potential of the material is not achieved when a military explosive or propellant is used as an extender. In addition, the mixture gives rise to toxic fumes such as CO, $NO_x$ and HCN when it is detonated and any chlorine in the explosive or propellant may end up in the form of chlorinated dibenzodioxins or dibenzofurans.

SUMMARY OF THE INVENTION

In view of the above, it is an object of the present invention to provide an environmentally neutral process for reformulating military explosives and propellants into a useful form for which there is a ready market. It is another object to provide a method for reformulating military polymer bound explosives and solid rocket propellants in a form which does not waste the energetic potential of the explosive or propellant and which minimizes the production of toxic fumes. Other objects and features of the invention will be in part apparent and in part pointed out hereinafter.

A process for reformulating explosives and propellants in accordance with the present invention and the products thereof includes the steps of selecting an oxygen deficient polymer or wax bound military explosive or propellant and determining its empirical formula. An oxidizing agent is then selected and the amount of the oxidizing agent necessary to oxygen balance the explosive is determined. That amount of oxidizing agent is added to the explosive whereby the energetic potential of the explosive is maximized and the production of toxic fumes minimized when the reformulated explosive is detonated. Gas and heat modifying agents such as urea may be added to modify the explosive power. Mixtures of explosives and propellants reformulated in accordance with the present invention may be used to modify the power or the sensitivity of the reformulated mixture to initiation.

The invention summarized above comprises the processes and products hereinafter described, the scope of the invention being indicated in the subjoined claims.

DETAILED DESCRIPTION OF THE INVENTION

Explosives are materials that, when properly initiated, undergo very rapid self-propagating decomposition or reaction of ingredients, with the consequent formation of more stable materials (mostly gaseous) and the liberation of considerable heat. The products of explosion occupy a much greater volume than that of the explosive material. Furthermore, the liberated heat expands the gaseous products, thereby developing a high pressure that can be applied to doing work. The work done (or energy liberated) depends primarily on the amount of heat given off during the explosion and quantity of gases generated.

Explosives may consist of a single explosive chemical compound, a formulation of such compounds, or a formulation of one or more explosive compounds with nonexplosive material. Each explosive product has unique and important individual characteristics that determine its potential usefulness to specific applications. These include sensitivity, strength, power, brisance, stability, hygroscopicity, volatility, reactivity and toxicity.

Industrial Explosives

Industrial explosives compose a large group of explosive compositions designed to perform mechanical work such as quarrying, ore dislodgement, ditching and excavation with a low expenditure of time and money. They are categorized as either high explosives or blasting agents; the principal distinction being their sensitivity to initiation. High explosives are cap-sensitive (i.e., can be detonated with a No. 8 blasting cap), but blasting agents cannot, and therefore require a primer for initiation.

Industrial high explosives include dynamites, cap-sensitive water gels and emulsion slurries, cast primers and boosters. "Permissible" explosives are grades of high explosives tested by the U.S. Bureau of Mines and approved by the Mine Safety and Health Administration for use, in a prescribed manner, in underground coal mines where the presence of flammable gases and dust makes other explosives hazardous.

Blasting agents are insensitive to commercial detonators or blasting caps. Most blasting agents are essentially mixtures of ammonium nitrate (AN) plus a fuel. Free-flowing mixtures of AN (usually in the form of low-density prills) and fuel oil called ANFO and bulk-mixed water gels and emulsion slurries are used extensively. AN blasting agents dominate the industrial market.

Military Explosives

Military explosives include propellants and high explosives. Propellants are explosive materials formulated in a manner permitting the generation of large volumes of hot gas at highly controlled predetermined rates. The major use of propellants is for launching projectiles from guns, rockets and missile systems. There are composite propellants, double-base propellants and composite modified double-base propellants.

Composite propellants consist primarily of a binder material such as polybutadiene and a finely ground solid fuel (such as aluminum) and an oxidizer (such as ammonium perchlorate) . Double-base propellants consist primarily of stabilized nitrocellulose (NC) and nitroglycerine (NG) . Composite modified double-base propellants use a double-base propellant for a binder, with the solid fillers commonly found in composite propellants.

A number of binder materials are used in the manufacture of composite propellants. Among these are asphalt, polysulfides, polystyrene-polyester and polyurethanes. Propellants of recent development are predominantly products of the polybutadiene family such as carboxy-terminated polybutadiene, hydroxy-terminated polybutadiene and carboxy-terminated polybutadiene-acrylonitrile. In composite propellants, the binder also serves as a fuel so that the addition of a separate fuel is not always necessary. While the addition of metallic fuels to the propellant significantly increases the energy of the propellant, it also produces primary smoke in the form of metal oxides. The most commonly added metal is aluminum, but magnesium, beryllium and other metals have been tried. The commonly used oxidizer (which makes up the preponderance of the weight of the propellant) is ammonium perchlorate. Other oxidizers which have been used include ammonium nitrate, potassium nitrate and potassium perchlorate.

Double-base propellants contain nitrocellulose of various nitration levels, nitroglycerine and a stabilizer. Various inert plasticizers are added to modify either the flame temperature or the physical properties of the propellant.

Composite modified double-base propellants classically have contained nitrocellulose, nitroglycerine, aluminum, ammonium perchlorate and the explosive 1,3,5,7-tetranitro-1,3,5,7-tetraazacyclooctane (HMX) which serves as a fuel, energy source and gas-producing additive.

Military high explosives include binary 2,4,6-trinitrotoluene (TNT)-based formulations, TNT-based aluminized explosives and plastic-bonded explosives. Binary TNT-based formulations are made by adding a higher melting explosive component to liquefied TNT. The most widely used binary explosive, Composition B, is made by adding 1,3,5-trinitrohexahydro-s-triazine (RDX) to TNT. Other compounds may be added to decrease sensitivity and to increase the mechanical strength of the cast. Composition B (or slightly modified formulations) is used in loading projectile and warheads and as the starting material for making aluminized explosives. Other binary military explosive mixtures include the octols (HMX+TNT), cyclotols (RDX+TNT), pentolites (pentaerythritol tetranitrate (PETN)+TNT), tetrytols (tetryl+TNT), amatols (ammonium nitrate+TNT) and picratols (ammonium picrate+TNT).

TNT-based aluminized explosives are made by the addition of screened, finely divided aluminum particles to a melted, binary TNT-based slurry, such as Composition B (RDX+TNT). A desensitizer and calcium chloride may be added to the mixture. The incorporation of aluminum increases the blast effect of explosives. Typical TNT-based aluminized explosives are the tritonals (TNT+Al), ammonals (TNT+AN+Al) and the torpexes and HBXs (TNT+RDX+Al).

If an explosive compound is too sensitive in its pure crystalline state to permit press loading, or it lacks the required mechanical properties in its compressed state for subsequent use, it may be coated with polymeric materials or waxes to form molding powders. These molding powders are known as plastic-bonded explosives (PBX). Thorough and uniform coating of the explosive crystals is required for desensitization. They are generally prepared with 80–95% RDX or HMX.

Reformulation of Propellants and High Explosives

As discussed above, the disposal of military explosives and propellants is a growing problem. The Resources Conservation and Recovery Act (RCRA) places a premium on waste management programs that recover and use portions (preferably all) of a waste stream. Processes which do not meet the RCRA criteria are not favored by the U.S. Environmental Protection Agency (EPA).

The avoidance of toxic fumes or fumes that can give a secondary explosion is not of high importance in the case of military explosives and propellants so that most are oxygen deficient. One reason behind this is that the power benefit of having an oxygen balance may not outweigh the added energy requirement of getting the charge to a target. Sensitivity and formulation problems may be other reasons since, inter alia, military propellants and high explosives must be transported safely and stored in readiness sometimes for long periods of time.

In accordance with the present invention, an oxygen deficient military explosive or propellant is selected for reformulation as a blasting agent or the like. The explosive or propellant is cut, ground or otherwise divided into small particles for example with a high pressure waterjet. Suitable materials for reformulation include but are not limited to oxygen deficient polymer bound explosives, oxygen deficient polymer and wax bound propellants, oxygen deficient nitrocellulose bound propellants and mixtures thereof.

Some examples of polymer bound explosives (PBX) not treated in the examples, include, PBX-9010 (90% RDX, 10% Kel-F), PBX-9011 (90% HMX, 10% estane), PBX-9404-03 (94% HMX, 3% NC and 3% chloroethylphosphate), PBX-9205 (92% RDX, 6% polystyrene, 2% ethylhexylphthalate), PBX-9501 (92% HMX, 2.5% dinitropropyl acrylate-fumarate and 2.5% estane), PBXN-1 (68% RDX, 20% aluminum, 12% nylon) and PBXN-2 (95% HMX and 5% nylon). All of these can be pressed to fill a desired volume. The explosive PBXN-201 (83% RDX, 12% Viton and 5% Teflon) can be extruded while the explosive PBXN-102 (59% HMX, 23% aluminum and 18% Laminac) can be cast. The explosive PBXC-303 (80% PETN and 20% Sylgard 183) can be injection molded. The explosives, Composition C (88.3% RDX and 11.7% non-explosive plasticizer), Composition C-2 (80% RDX and 20% explosive plasticizer), Composition C-3 (78% RDX and 22% explosive plasticizer) and Composition C-4 (90% RDX and 10% polyisobutylene) are some other examples of military explosives generally classified as plastic explosives.

Alternatively pure explosive compounds may be phlegmatized by adding a phlegmatizer, particularly wax. This is specially true with the very brisant explosives, RDX, HMX and PETN. The addition of a phlegmatizer has the benefit of permitting the safe compression of the resulting mixture to maximize density and hence more closely approach the maximum power per unit volume available from the explosive. If the explosives were compressed without the presence of a phlegmatizing agent, there would be considerable danger of initiation as a consequence of the friction sensitivity of these materials. The added wax serves the dual role of lubricant and binder. Some examples include Compositions A, A-2 and A-3, which are based on RDX and differ by the various kinds of wax they contain. Compositions B and B-2 are castable mixtures of RDX and TNT in the proportion 60:40 and some of these are also formulated with waxes.

The empirical formula of the selected explosive or propellant is determined and its oxygen deficiency calculated. The empirical formula includes the explosive material and any materials added to improve or alter its properties as well as any adventitious organic materials (such as glue which is recovered with the explosive or propellant from a rocket casing, warhead, etc.). An oxidizing agent is selected, its empirical formula determined and the amount of oxidizing agent needed to bring the explosive or propellant to near or substantial oxygen balance calculated.

Suitable oxidizing agents include salts of oxy-acids such as nitric acid, chloric acid, bromic acid and perchloric acid. The most common salts are those derived from lithium, sodium, potassium, magnesium and calcium. In the case of perchloric acid and nitric acid, the related ammonium salts can also be employed. On the basis of cost, ammonium nitrate is preferred but ammonium perchlorate, calcium nitrate, calcium nitrate tetrahydrate, calcium perchlorate, lithium nitrate, lithium perchlorate, magnesium nitrate, magnesium perchlorate, potassium nitrate, potassium perchlorate, sodium nitrate, sodium perchlorate and so forth can also be used. The oxidizing agent is preferably provided in finely divided form, for example, as small prills, fine crystals or powders of 8 mesh or finer.

The oxidizing agent is mixed with the explosive and the mixture provided in an acceptable form such as a flowable mixture or as a gel or slurry. In some cases, a gas forming material such as urea may be added to increase the volume of gases produced and work obtained when the oxygen balanced mixture is detonated. Other materials such as ammonium oxalate, oxamic acid, oxamide, methyl urea, urea-formaldehyde resins, nitroguanidine, nitrourea, urea nitrate and nitric acid may be added in place of or in conjunction with urea for the purpose of modifying the explosive power by regulating the amount of heat and gas liberated. Mixtures of reformulated military explosives or propellants (such as PBXN-4 oxygen balanced with AN and PBXN-4 oxygen balanced with sodium perchlorate (SP)) may also be used to modify the explosive power by regulating the amount of heat and gas liberated and/or modifying the sensitivity of the reformulated explosive to initiation.

In general, most military propellants and high explosives reformulated in accordance with the present invention liberate more energy than commonly used AN blasting agents on a comparable weight basis. This makes possible the use of smaller holes and expanded blast hole patterns thus reducing drilling costs (on a per-yard-of-rock basis), leading to a ready market for the reformulated material.

The following examples illustrate the invention.

EXAMPLE 1

The theoretical explosive potential of several military explosives were screened based on their chemical composition and density (rho in g/cc) using a Hess Law treatment of the heat of explosion (Q in cal/g mole) and an estimation of the detonation pressure (PD in Kbar) and detonation velocity ($V_D$ in km/sec) employing the method of Kamlett and Jacobs (M. J. Kamlett and S. J. Jacobs, J. Chem. Phys., 48, 23 (1968)) . The power factor (PF) was determined by multiplying $V_D$ by $P_D$ and by $10^{-3}$ and normalized against the power factor for ANFO ($NP_F$). ANMFO is an industrial explosive containing 94.5% by weight ammonium nitrate and 5.5% by weight fuel oil. The results for PBXN-101, PBXN-105, PBXN-106, PBXN-3, PBXN-4, PBXN-5, PBXN-6 and AFX-108 are reported in Table I below.

TABLE I

| Formulation | $P_D$ | $V_D$ | Q | Rho | $P_F$ | $NP_F$ |
|---|---|---|---|---|---|---|
| PBXN-101 | 328 | 8.67 | 654 | 1.76 | 2.84 | 0.23 |
| PBXN-105 | 280 | 7.81 | 1769 | 2.01 | 2.19 | 0.24 |
| PBXN-106 | 286 | 8.17 | 1136 | 1.69 | 2.34 | 0.26 |
| PBXN-3 | 260 | 7.86 | 740 | 1.69 | 2.04 | 0.28 |
| PBXN-4 | 206 | 7 | 459 | 1.7 | 1.44 | 0.33 |
| PBXN-5 | 398 | 9.25 | 1138 | 1.95 | 3.68 | 0.19 |
| PBXN-6 | 340 | 8.75 | 1144 | 1.82 | 2.98 | 0.22 |
| AFX-108 | 259 | 7.77 | 1119 | 1.70 | 2.01 | 0.26 |

PBXN-101 is 82% by weight HMX and 18% by weight polystyrene and has an elemental composition on a 100 g basis of approximately $C_{2.528}H_{3.628}N_{2.19912.199}$.

PBXN-105 is approximately 26% by weight aluminum, 50% by weight ammonium perchlorate, 6.5% by weight bis-(2,2-dinitropropyl)acetal (bis-DNPA), 6.5% by weight bis-(2,2-dinitropropyl)formal (bix-DNPF), 3% by weight PEG, 7% by weight RDX and 1% by weight TDI. PEG is polyethylene glycol and TDI is toluene diisocyanate. PBXN-105 has an elemental composition on a 100 g basis of approximately $C_{0.62}H_{2.73}H_{0.85}O_{2.30}Al_{0.96}Cl_{0.42}$.

PBXN-106 is 9.3% by weight bis-DNPA, 9.3% by weight bis-DNPF and 75% by weight RDX with the balance being a polyurethane binder formed from TDI, PEG and 1,1-(hydroxymethyl)propane and has an elemental composition on a 100 g basis of approximately $C_{1.791}H_{3.270}N_{2.281}O_{2.726}$.

PBXN-3 is approximately 86% by weight HMX and 14% by weight nylon (i.e., ZYTEL TM or ELVAMIDE TM). It has an elemental composition on a 100 g basis of approximately $C_{2.00}H_{3.68}N_{2.45}O_{2.45}$.

PBXN-4 is 94% by weight DATB and 6% by weight nylon (i.e., ZYTEL TM) and has an elemental composition on a 100 g basis of approximately $C_{2.64}H_{3.29}N_{1.9902.37}$. DATB is 1,3-diamino-2,4,6-trinitrobenzene.

PBXN-5 is 5% by weight copolymer of vinylidene fluoride and hexafluoropropylene and 95% by weight HMX and has an elemental composition on a 100 g basis of approximately $C_{1.23}H_{2.672}N_{2.578}O_{2.578}F_{0.174}$.

PBXN-6 is 5% by weight copolymer of vinylidene fluoride and hexafluoropropylene and 95% by weight RDX and has an elemental composition on a 100 g basis of approximately $C_{1.23}H_{2.672}N_{2.578}O_{2.578}F_{0.174}$.

AFX-108 is 82% by weight RDX, 5% by weight isodecylpelargonate with the balance being a polyurethane binder and small quantities of stabilizers. It has an elemental composition on a 100 g basis of approximate $C_{2.10}H_{3.85}N_{2.25}O_{2.48}$.

EXAMPLE 2

To obtain the maximum amount of energy available from an explosive, it is necessary to obtain oxygen balance. The military explosives in Example 1 are oxygen deficient on a 100 g basis as shown in Table II.

TABLE II

| Formulation | Oxygen Deficiency |
|---|---|
| PBXN-101 | 4.66 gram atoms |
| PBXN-105 | 2.45 |
| PBXN-106 | 2.70 |
| PBXN-3 | 4.66 |
| PBXN-4 | 4.55 |
| PBXN-5 | 1.13 |
| PBXN-6 | 1.13 |

The theoretical explosive potential of bringing the explosives to oxygen balance by adding the amount of oxygen shown in Table II as ammonium nitrate was then determined. The results are given in Table III.

TABLE III

| Formulation | PBX Base | AN | $P_D$ | $V_D$ | Q | Rho | $P_F$ | $NP_F$ |
|---|---|---|---|---|---|---|---|---|
| WED-88 | PBXN-101 | 373 | 323 | 8.53 | 1001 | 1.8 | 2.76 | 4.96 |
| WED-90 | PBXN-105 | 196 | 350 | 8.74 | 1322 | 1.88 | 3.06 | 5.75 |
| WED-91 | PBXN-106 | 216 | 399 | 9.57 | 1742 | 1.69 | 3.82 | 6.46 |
| WED-71 | PBXN-3 | 373 | 311 | 8.45 | 1039 | 1.75 | 2.63 | 4.60 |
| WED-72 | PBXN-4 | 364 | 319 | 8.45 | 981 | 1.79 | 2.71 | 4.84 |
| WED-73 | PBXN-5 | 123.5 | 339 | 8.74 | 1151 | 1.81 | 2.96 | 5.36 |
| WED-74 | PBXN-6 | 123.5 | 321 | 8.58 | 1153 | 1.75 | 2.75 | 4.82 |

EXAMPLE 3

DATB can be recovered from PBXN-4 by solvent trituration. The theoretical explosive potential of DATB when it is oxygen balanced with several different oxidizers is given in Table IV.

TABLE IV

| Formulation | Oxidizer | Amount | $P_D$ | $V_D$ | Q | Rho | $P_F$ | $NP_F$ |
|---|---|---|---|---|---|---|---|---|
| WED-100 | AN | 214 | 315 | 8.51 | 1131 | 1.75 | 2.68 | 4.69 |
| WED-101 | AP[1] | 125.7 | 410 | 9.46 | 1435 | 1.9 | 3.88 | 7.37 |
| WED-102 | HP[2] | 177.2 | 420 | 9.57 | 1559 | 1.9 | 4.02 | 7.64 |
| WED-103 | LIN[3] | 133.9 | 451 | 9.59 | 835 | 2.15 | 4.33 | 9.30 |

In the above table, AP[1] is ammonium perchlorate, HP[2] is hydrazinium perchlorate and LIN[3] is lithium nitrate.

EXAMPLE 4

Packing density influences both detonation velocity and pressure. The theoretical impact of packing density for PBXN-101 brought to oxygen balance with AN is shown in Table V below.

TABLE V

| rho | $V_D$ | $P_D$ | $P_F$ |
|---|---|---|---|
| 0.90 | 5.54 | 81 | 0.45 |
| 1.00 | 6.04 | 100 | 0.58 |
| 1.10 | 6.20 | 120 | 0.75 |
| 1.20 | 6.54 | 143 | 0.94 |
| 1.30 | 6.87 | 168 | 1.15 |
| 1.40 | 7.20 | 195 | 1.40 |
| 1.50 | 7.53 | 224 | 1.69 |

TABLE V-continued

| rho | $V_D$ | $P_D$ | $P_F$ |
|---|---|---|---|
| 1.60 | 7.86 | 255 | 2.00 |
| 1.70 | 8.20 | 288 | 2.36 |
| 1.80 | 8.53 | 323 | 2.75 |

EXAMPLE 5

Samples of formulations based upon the polymer bound explosives PBXN-3, PBXN-4, PBXN-101, PBXN-105 and AFX-108 and the class 1.1 solid rocket propellants DDP, VTQ-3 and VTG-5A were oxygen balanced and packaged in sticks having lengths varying from 7.00 to 17.25 inches and diameters from 1.4687 inches to 2.25 inches and detonated. All sticks detonated. Details are given in Table 6 below.

DDP is a composite double base aluminized Class 1.1 military solid rocket propellant containing ammonium perchlorate and having the approximate 100 g empirical formula $C_{1.84}H_{2.39}N_{1.50}O_{2.06}Al_{0.78}Cl_{0.17}$and is approximately 3.88 gram atoms of oxygen deficient per 100 grams of propellant.

VTQ-3 is a Class 1.1 solid military rocket propellant containing nitroglycerin, ammonium perchlorate and aluminum plus various other components. It has an approximate 100 gram empirical formula of $C_{1.07}H_{2.15}N_{1.52}O_{2.78}Al_{0.59}Cl_{0.07}$ and is approximately 2.32 gram atoms of oxygen deficient per 100 grams of propellant. VTQ-3 is a classified propellant, hence the empirical formula and oxygen deficiency is very approximate.

VTG-5A is a Class 1.1 complex military solid rocket propellant containing nitroglycerin, aluminum and ammonium perchlorate and is approximately 1.64 grams atoms of oxygen deficient per 100 grams of propellant and with an approximate 100 gram empirical formula of $C_{0.98}H_{2.00}N_{1.49}O_{2.36}Al_{0.72}Cl_{0.085}$.

TABLE VI

| Stick | Military Base | Oxidizer | Weight | Length | Rho |
|---|---|---|---|---|---|
| 1 | PBXN-4 | SP | 442.94 g | 13.31 in | 1.06 |
| 2 | AFX-108 | AN | 373.56 | 13.25 | 0.897 |
| 3 | PBXN-4 | SP/AN | 448.90 | 13.34 | 1.07 |
| 4 | PBXN-101 | AN | 516.12 | 14.16 | 1.16 |
| 5 | PBXN-101 | AN/Urea/AN | 491.48 | 12.39 | 1.11 |
| 6 | PBXN-101 | AN | 445.78 | 13.02 | 1.09 |
| 7 | PBXN-4 | SP | 513.33 | 12.92 | 1.26 |
| 8 | PBXN-4 | AN | 298.65 | 8.25 | 1.15 |
| 9 | PBXN-101 | AN | 209.00 | 7.00 | 0.95 |
| 10 | PBXN-105 | AN/Urea/AN | 436.52 | 13.38 | 1.04 |
| 11 | PBXN-101 | AN | 467.44 | 14.56 | 1.02 |
| 12 | PBXN-101 | AN | 443.16 | 14.22 | 0.99 |
| 13 | DDP | AN | 402.00 | 14.25 | 1.02 |
| 14 | VTQ-3 | AN | 365.00 | 12.75 | 1.03 |
| 15 | PBXN-4 | AN/SP | 382.00 | 14.5 | 0.95 |
| 16 | VTG-5A | AN | 422.00 | 14.5 | 1.05 |
| 17 | AFX-108 | AN | 358.00 | 13.25 | 0.97 |
| 18 | PBXN-4 | AN | 347.00 | 13.5 | 0.93 |
| 19 | PBXN-4 | SP | 402.00 | 13.25 | 1.09 |
| 20 | PBXN-101 | AN/Urea | 348.60 | 14.00 | 0.90 |
| 21 | DDP | AN | 307.00 | 11.5 | 0.96 |
| 22 | PBXN-105 | AN/Urea | 431.00 | 15.0 | 1.04 |
| 23 | AFX-108 | AN | 334.00 | 12.25 | 0.98 |
| 24 | PBXN-3 | AN | 362.2 | 14.25 | 0.92 |
| 25 | PBXN-3 | AN | 394.81 | 13.75 | 0.90 |
| 26 | PBXN-3 | AN | 339.50 | 13.50 | 0.91 |
| 27 | Mixture | | 504.00 | 17.25 | 0.95 |

Sticks 1–12 has a cross section of 10.93 $cm^2$ and a diameter of 115/32 inch. The oxidizer was in the form of powder. Sticks 13–26 had a cross section of 12.37 $cm^2$ and a diameter of 19/16 inch. The oxidizer was in the form of prills. All sticks with the exception of stick 9 were filled under a packing thrust of 400 pounds. Stick 9 was filled under a thrust of 450 pounds. All polymer bound explosives were ground fine with the exception of PBXN-105 which was coarse. All 1.1 rocket propellants were coarse.

Each stick was outfitted with a 7 g PENTOLITE stinger (a 50 pourable mixture of TNT and PETN with a density of 1.65 g/$cm^3$ and a detonation rate of 7400 m/sec) and a No. 8 blasting cap.

EXAMPLE 6

Samples of formulations based on the polymer explosives PBXN-101 and PBXN-4 were oxygen balanced and packaged in sticks. The sticks were provided with a 7 g PENTOLITE stinger and a No. 8 blasting cap. The sticks were detonated and the velocity of detonation measured with point ionization probes attached to a VOD meter. The results are reported in Table 7 below.

TABLE VII

| Stick | Pack | PBX Base | Oxidizer | Weight | Length | Rho | VOD |
|---|---|---|---|---|---|---|---|
| 1 | 200# | PBXN-101 | AN | 433 g | 34.6 cm | 0.99 | 4.00 |
| 2 | 300# | PBXN-4 | SP | 519 | 33.6 | 1.15 | 3.78 |
| 3 | 150# | PBXN-4 | SP | 519 | 33.6 | 1.15 | 3.49 |
| 5 | loose | PBXN-101 | AN | 105 | 10.2 | 0.95 | 2.42 |
| 6 | loose | PBXN-101 | AN | 408 | 39.4 | 0.95 | 5.79 |
| 7 | loose | PBXN-101 | AN | 409 | 39.4 | 0.95 | 5.10 |

As various changes could be made in the above-described methods and products without departing from the scope of the invention, it is intended that all matter contained in the above description or shown in the accompanying drawing shall be interpreted as illustrative and not in a limiting sense.

What is claimed:

1. A process for reformulating a military explosive or propellant which comprises the steps of:

(a) selecting an oxygen deficient polymer or wax bound military explosive or propellant;

(b) determining the empirical formula of the explosive or propellant;

(c) selecting an oxidizing agent;

(d) determining the amount of oxidizing agent necessary to oxygen balance the explosive or propellant including the polymer or wax;

(e) dividing the polymer bound or wax bound explosive into particles; and, (f) adding the amount of oxidizing agent determined in step (d) to the particles of the polymer or wax bound explosive or propellant whereby the energetic potential of the explosive or propellant is maximized and the production of toxic fumes minimized when the reformulated mixture is detonated.

2. The process of claim 1 wherein the military explosive or propellant includes a member selected from the group consisting of RDX, HMX, PETN and mixtures thereof.

3. The process of claim 2 wherein the oxidizer is a metal or ammonium salt of an oxy-acid selected from the group consisting of nitric acid, chloric acid, bromic acid, perchloric acid and mixtures thereof.

4. The process of claim 1 wherein a gas forming material is added with the oxidizing agent to modify the explosive power of the reformulated mixture by regulating the amount of heat and gas liberated.

5. A process for reformulating a military explosive or propellant which comprises the steps of:

(a) selecting an oxygen deficient polymer or wax bound military explosive or propellant containing an explosive member selected from the group consisting of RDX, HMX, PETN and mixtures thereof;

(b) determining the empirical formula of the explosive or propellant including the polymer or wax;

(c) selecting an oxidizing agent which is a metal or ammonium salt of an oxy-acid selected from the group consisting of nitric acid, chloric acid, bromic acid, perchloric acid and mixtures thereof;

(d) determining the amount of oxidizing agent necessary to oxygen balance the explosive or propellant including the polymer or wax;

(e) dividing the explosive or propellant into particles; and, (f) adding the amount of oxidizing agent determined in step (d) to the particles of the polymer or wax bound explosive or propellant whereby the energetic potential of the explosive or propellant is maximized and the production of toxic fumes minimized when the reformulated mixture is detonated.

6. The process of claim 5 wherein a gas forming material is added with the oxidizing agent to modify the explosive power of the reformulated mixture by regulating the amount of heat and gas liberated.

7. The process of claim 6 wherein the gas forming material is selected from the group consisting of urea, ammonium oxalate, oxamic acid, oxamide, methyl urea, urea-formaldehyde resins, nitroguanidine, nitrourea, urea nitrate, nitric acid and mixtures thereof.

8. The process of claim 5 wherein the oxidizer is provided in a finely divided form.

9. The process of claim 5 wherein the military explosive or propellant is oxygen balanced with at least two different oxidizing agents to modify the explosive power of the reformulated mixture.

10. The process of claim 5 wherein at least two different military explosives or propellants are selected.

11. The process of claim 5 wherein adventitious materials present in the military explosive or propellant serve as fuel when the reformulated mixture is detonated.

* * * * *